US008840488B2

(12) United States Patent
Evans

(10) Patent No.: US 8,840,488 B2
(45) Date of Patent: Sep. 23, 2014

(54) GOLF PUTTER

(75) Inventor: Robert Evans, Clearwater, FL (US)

(73) Assignee: 4321 Holding Company, LLC, Tallahassee, FL (US)

( * ) Notice: Subject to any disclaimer, the term of this patent is extended or adjusted under 35 U.S.C. 154(b) by 454 days.

(21) Appl. No.: 13/159,967

(22) Filed: Jun. 14, 2011

(65) Prior Publication Data

US 2012/0322576 A1 Dec. 20, 2012

(51) Int. Cl.
*A63B 53/04* (2006.01)

(52) U.S. Cl.
CPC ..... *A63B 53/0487* (2013.01)
USPC ..... 473/325; 473/340

(58) Field of Classification Search
USPC ..... 473/324–350
See application file for complete search history.

(56) References Cited

U.S. PATENT DOCUMENTS

| | | | | | |
|---|---|---|---|---|---|
| 2,472,978 | A * | 6/1949 | Mahon | 473/325 |
| 3,869,126 | A * | 3/1975 | Thompson | 473/331 |
| 4,162,074 | A * | 7/1979 | Thomson | 473/330 |
| 4,295,650 | A * | 10/1981 | Keeble | 273/118 R |
| 4,512,583 | A * | 4/1985 | Leveque de Vilmorin | 473/245 |
| 5,322,285 | A | 6/1994 | Turner | |
| 5,354,060 | A * | 10/1994 | Wooten | 473/313 |
| 5,383,664 | A * | 1/1995 | Epperson | 473/340 |
| 5,390,918 | A * | 2/1995 | Meyers et al. | 473/246 |
| 5,511,779 | A * | 4/1996 | Meyers et al. | 473/246 |
| 5,830,075 | A * | 11/1998 | Hirose | 473/313 |
| 5,857,922 | A | 1/1999 | Delio | |
| 5,863,262 | A * | 1/1999 | Donofrio | 473/330 |
| 6,183,379 | B1 * | 2/2001 | Kim et al. | 473/325 |
| 6,183,380 | B1 * | 2/2001 | Yim | 473/330 |
| 6,287,215 | B1 * | 9/2001 | Fisher | 473/309 |
| 6,340,336 | B1 * | 1/2002 | Loconte | 473/251 |
| 7,134,970 | B2 | 11/2006 | Lindsay | |
| 7,837,576 | B1 | 11/2010 | Paige | |
| 7,850,538 | B1 * | 12/2010 | Yoon | 473/251 |
| 7,922,602 | B2 * | 4/2011 | Johnson | 473/330 |
| 8,062,148 | B1 * | 11/2011 | Farkas | 473/313 |

(Continued)

FOREIGN PATENT DOCUMENTS

| | | | | |
|---|---|---|---|---|
| EP | 631797 A1 * | 1/1995 | | A63B 53/04 |
| EP | 1203601 A2 * | 5/2002 | | A63B 53/00 |

(Continued)

*Primary Examiner* — Alvin Hunter
(74) *Attorney, Agent, or Firm* — Adrienne C. Love

(57) ABSTRACT

A golf putter comprised of a shaft having an axis, a hosel attached to the shaft and a head attached to the hosel. The head of the putter has a face, a top and a sole. The face of the putter is comprised of multiple facets with a degree of static loft measured from the plane of the facet to the axis of the shaft. It is preferable that there are at least four facets on the face of the putter. The first facet is proximate to the sole of the face and has a first static loft angle. The second facet is above and abuts the first facet and has a second static loft angle which is greater than the first static loft angle. The third facet abutting and above the second facet has a third static loft angle which is greater than the second static loft angle. The fourth facet abuts and is above the third facet and has a fourth static loft angle which is greater than the third static loft angle. It is preferable that the static loft angles of said at least four facets differ by only 1 degree between abutting facets.

5 Claims, 14 Drawing Sheets

(56) References Cited

U.S. PATENT DOCUMENTS

| | | | |
|---|---|---|---|
| 2002/0128090 | A1 | 9/2002 | Slucker et al. |
| 2004/0014533 | A1 | 1/2004 | Joo et al. |
| 2005/0255930 | A1 | 11/2005 | Johnson |
| 2008/0125241 | A1 | 5/2008 | Tateno et al. |
| 2009/0209363 | A1 | 8/2009 | Johnson |

FOREIGN PATENT DOCUMENTS

| | | | | | |
|---|---|---|---|---|---|
| JP | 07148293 | A | * | 6/1995 | A63B 53/04 |
| JP | 07275412 | A | * | 10/1995 | A63B 53/04 |
| JP | 09108389 | A | * | 4/1997 | A63B 53/04 |
| JP | 11253589 | A | * | 9/1999 | A63B 53/04 |
| WO | WO 2007101971 | A1 | * | 9/2007 | A63B 53/04 |

* cited by examiner

GOLF PUTTER

CROSS-REFERENCES TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of golf putters. More specifically, the invention comprises a golf putter having variable loft on the face of the putter.

2. Description of the Related Art

Golf clubs primarily include irons, woods and putters. A putter is designed to allow a golfer to hit from the green or the fringe of the green. Putting is typically thought of as the most precise aspect of the game of golf. A putter is therefore designed with precision in mind.

As shown in FIG. 1, a putter 10 generally has a shaft 12, head 14, hosel 20 and putter face 16. Each component part of a putter can vary to achieve different results. The face 16 of a putter perhaps offers the most variety between different putters. For example, a putter face 16 can contain grooves, an insert 18 of strips of metal or a softer polymer material. A degree of loft, or angle at which the club face lies, can be imparted to the club face. Thus, dependent on the type of putter face 16 utilized on a putter, a broad range of results can be achieved upon impact with the golf ball. Further, the hosel 20 can be bent (or angled) to give putter face 16 a different degree of loft relative to the shaft 12. This may be done to "fit" the putter to a particular golfer.

Referring to FIG. 2, the loft angle 22 is the angle at which the club face 16 lies relative to the vertical axis of the shaft 12 (i.e. angle between the line of club shaft orientation, arm A 24 and the club face plane 26). Manipulating, or bending, the hosel 20 impacts the angle of club face 16. For purposes of the present description the loft angle 22 will be called the "static loft angle" 22, thereby differentiating it from "dynamic loft" described herein. As loft increases more lift will be imparted to the ball. Typically, putter faces are flat and have some degree of loft. While the static loft angle in putters is less than the static loft angle in irons, the static loft angle still has a substantial effect on the path of travel of the golf ball.

It should be noted that loft at impact, or dynamic loft, can be significantly different than the "static loft" (described above) of the putter face. The dynamic loft, illustrated in FIG. 3, is the angle determined by the lean of the shaft and the path of the club head as the golfer swings and approaches the ball. The vertex of the dynamic loft angle 28 is located at the point of impact 30. The dynamic loft angle 28 is the angle at which the plane of the club face 32 lies relative to a vertical line extending along the central axis of the golf ball, or arm B 34. Thus the dynamic loft angle 28 is a combination of the static loft angle of the club face and how the golfer leans the shaft 12 and approaches the ball 36.

As shown in FIG. 4, the launch angle 38 is the angle at which the golf ball 36 is launched into the air after contacting putter face 16. Launch vector 40 shows the projected path of golf ball 36. Launch angle 38 is the angle measured between launch vector 40 and horizontal plane 42, or a plane relative to the ground 44. Both the dynamic loft angle and static loft angle effect the launch angle 38. Or, in other words, the plane in which the putter face lies and the angle of approach on the golf ball effect the path of the golf ball after it is struck. However, these two factors should only be considered as two among many factors which affect the degree of launch angle 38.

When a golfer putts a ball it initially skids along the ground before it begins to roll. Minimizing the amount of skid of the ball increases the control the golfer retains over the ball. True roll is considered the moment that the ball achieves top-spin without skidding sideways and/or retaining backspin. The quicker the ball achieves true roll the more control the golfer has over the path and distance the golf ball travels.

Prior art putters have been designed with a flat or rounded face surface. When struck, with a positive launch angle, the golf ball typically slides or rolls up the club face and releases from the club with backspin; when it hits the ground some skidding results. A ball struck at too great of a positive launch angle can cause the ball to travel too far over the top of the grass, landing with additional backspin, causing skid and bounce. On a flat hard surface a golf ball hit on the upper portion of the ball with the bottom of the putter face would cause the ball to reach a true roll quickly with minimal skid. However, on the golf course, the ball sits slightly down in the grass, even on a flat green. Thus, hitting downward, or "topping" the ball will drive the ball into the ground, causing the ball to bounce thereby reducing control over distances. There is an optimal launch angle which encourages the ball to slightly lift, travel over the ground and reach a true roll quickly. However, even at the optimal launch angle, the golf ball will have an undesired amount of backspin due to the nature of the putter face. Thus, it would be desirable to have a putter face which encourages minimal backspin when struck with a desired launch angle.

After considering the principals affecting the launch angle of the golf ball, it can be inferred that a golfer who consistently strikes downward on the golf ball would benefit from a putter face having a static loft angle greater than the desired launch angle. The static loft angle, in this scenario, would overcorrecting for the golfer's erroneous dynamic loft angle, thereby achieving the desired launch angle for the golf ball. In the alternative, a golfer who consistently meets the golf ball at a positive 5° dynamic loft, for example, may benefit from a golf club having a smaller degree of static loft.

However, typically golfers are not aware of the relevance of dynamic loft or their own particular tendency at impact. Furthermore, golfers are not always consistent in their lean or angle of approaching and striking a golf ball. It is difficult to fit a particular golfer with the appropriately "lofted" club for ideal putting.

Additionally, prior art putters have been designed with the incorrect notion that the desired launch angle lies somewhere between positive 3-4°. It follows that most prior art putters are designed with a consistent loft angle between positive 2.5° and positive 5°. However, the desired launch angle, as further described herein, actually lies between positive 2-2.5°.

Therefore, what is needed is a putter which automatically provides for a corrective club face loft ("static loft") dependent on the angle of approach and lean of the shaft of the individual golfer whereby the golfer can achieve a desired launch angle between positive 2-2.5°. It is also desirable to produce a club face which reduces the amount of backspin imparted to the golf ball upon launch. The present invention achieves these objectives, as well as others that are explained in the following description.

BRIEF SUMMARY OF THE INVENTION

The present invention is a golf putter including a shaft having an axis, a hosel attached to the shaft, and a head attached to the hosel. The head of the putter has a face, a top and a sole. The face of the putter is comprised of multiple facets with a unique degree of static loft for each facet. It is preferable to include at least four facets on the face of the putter. The first facet is proximate to the sole of the face and has a first static loft angle. The second facet is above and abuts the first facet and has a second static loft angle which is greater than the first static loft angle. The third facet abutting and above the second facet has a third static loft angle which is greater than the second static loft angle. The fourth facet abuts and is above the third facet and has a fourth static loft angle which is greater than the third static loft angle. It is preferable that the static loft angles of the four facets differ by only 1 degree between abutting facets. The multiple facets preferably also contain a series of grooves and landings across the face of the putter.

The multiple facets of the putter allow the golfer to increase the chance of achieving optimal launch and act to grip the ball as it is shifting upward to release the golf ball with over-spin, thereby allowing the golfer to have greater control over the path of the golf ball.

REFERENCE NUMERALS IN THE DRAWINGS

Figure 1:
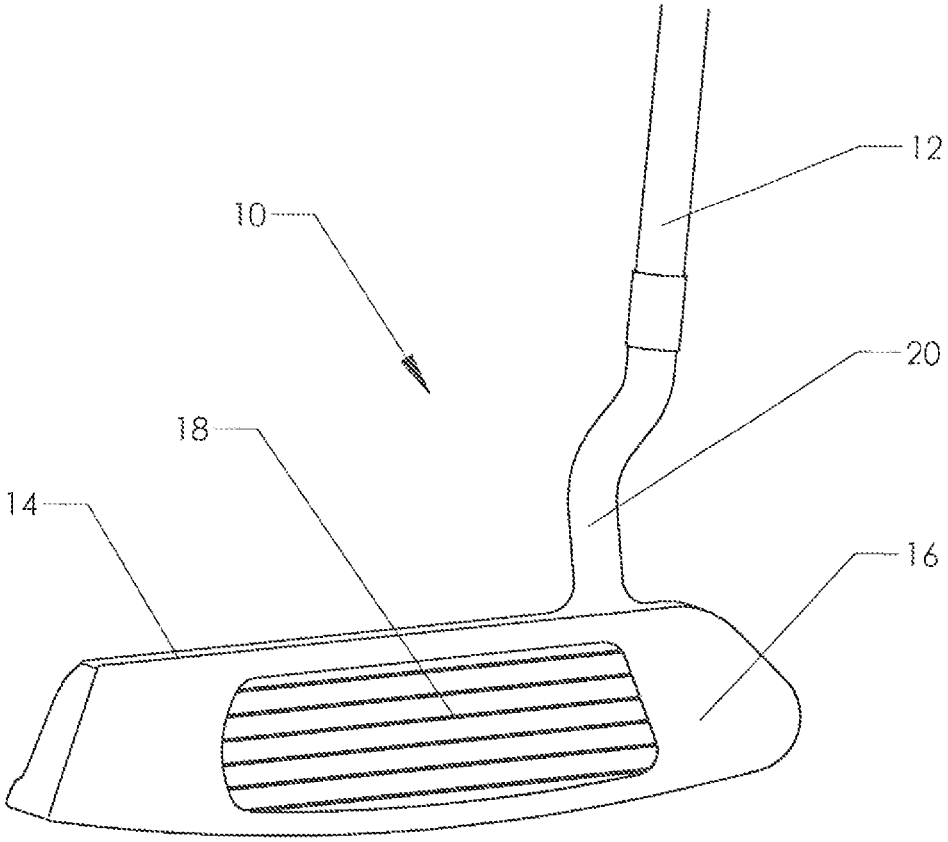
FIG. 1 (PRIOR ART)
FIG. 1 is a perspective view, showing a prior art putter.

| | | | |
|---|---|---|---|
| 10 | prior art putter | 12 | shaft |
| 14 | head | 16 | face |
| 18 | insert | 20 | hosel |
| 22 | static loft angle | 24 | arm A |
| 26 | club face plane | 28 | dynamic loft angle |

-continued

REFERENCE NUMERALS IN THE DRAWINGS

| | | | |
|---|---|---|---|
| 30 | point of impact | 32 | club face |
| 34 | arm B | 36 | golf ball |
| 38 | launch angle | 40 | launch vector |
| 42 | ground vector | 44 | ground level |
| 46 | back | 48 | top |
| 50 | putter | 52 | shaft |
| 54 | club head | 56 | face |
| 58 | grooves | 60 | hosel |
| 62 | first facet | 64 | second facet |
| 66 | third facet | 68 | fourth facet |
| 80 | sole | 82 | groove |
| 84 | landing | | |

DETAILED DESCRIPTION OF THE INVENTION

Figure 5:
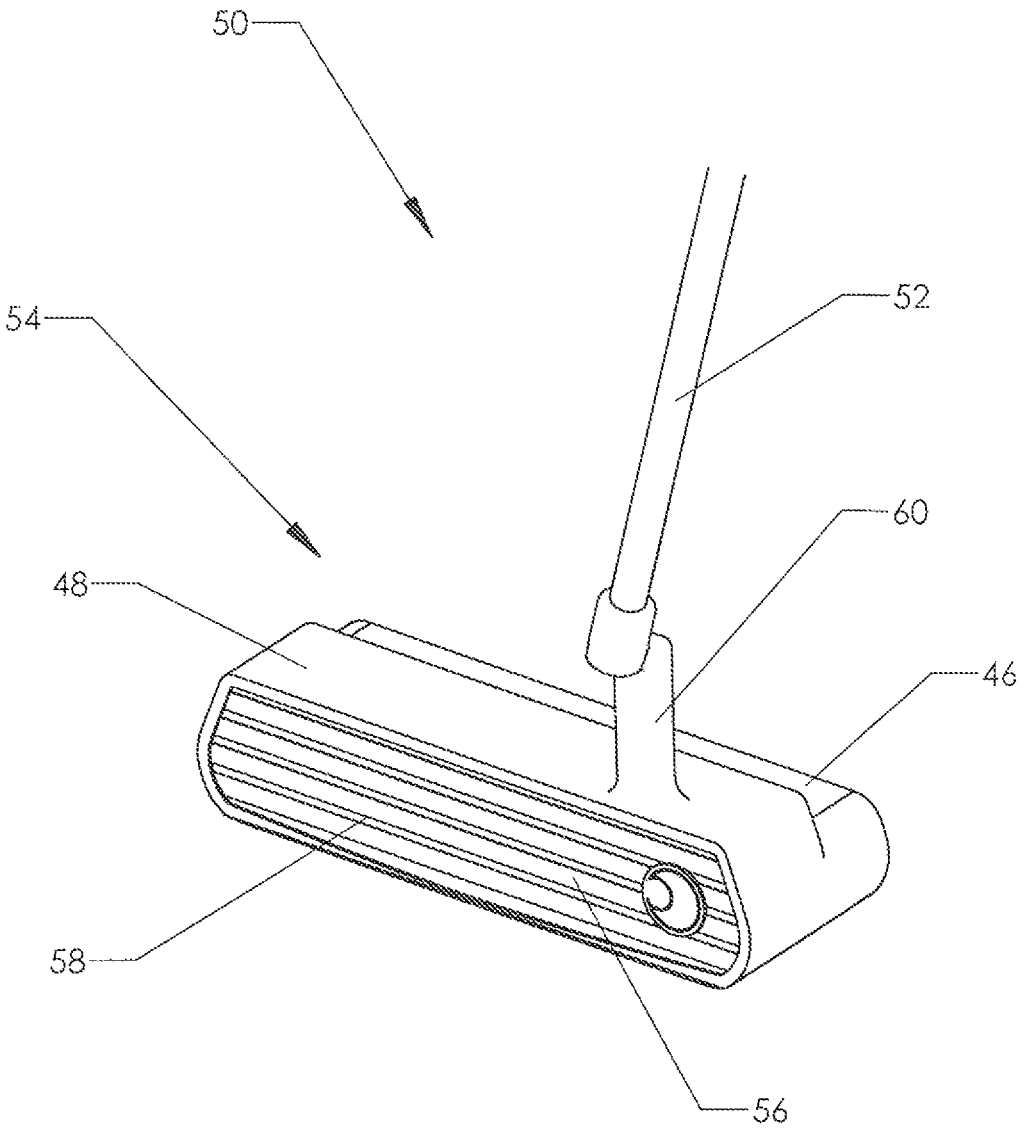
FIG. 5 is a perspective view, showing the present invention.

FIG. 5 illustrates the present putter 50 in one of the preferred embodiment. Putter 50 is generally comprised of shaft 52 and club head 54. Shaft 52 preferably includes hosel 60 and a grip (not shown). Hosel 60 connects shaft 52 to club head 54. Hosel 60 may include a suitable offset. Club head 54 includes face 56, sole (not shown), back 46 and top 48. In the preferred embodiment of the present putter 50, face 56 includes variable loft at multiple facets and a series of grooves 58, which are both further described herein.

Figure 2:
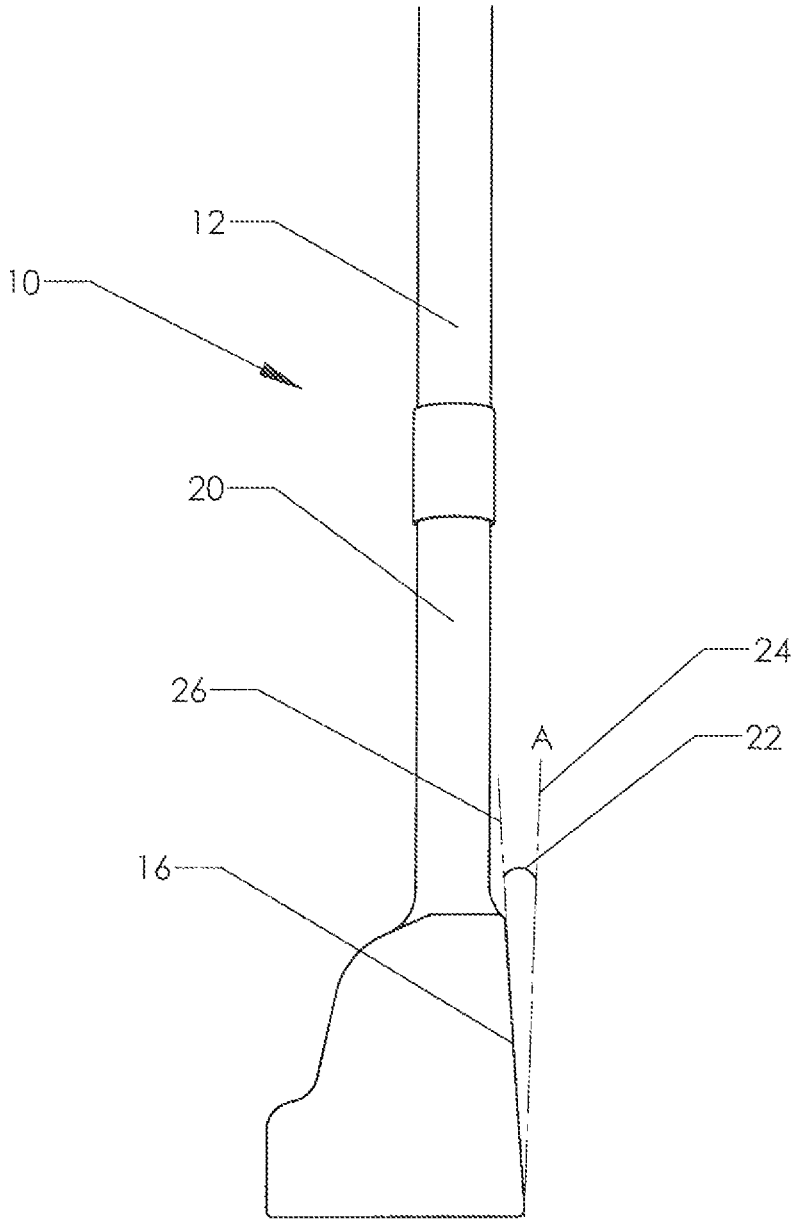
FIG. 2 (PRIOR ART)
FIG. 2 is a profile view, showing the angle of static loft for a prior art putter.
Figure 6:
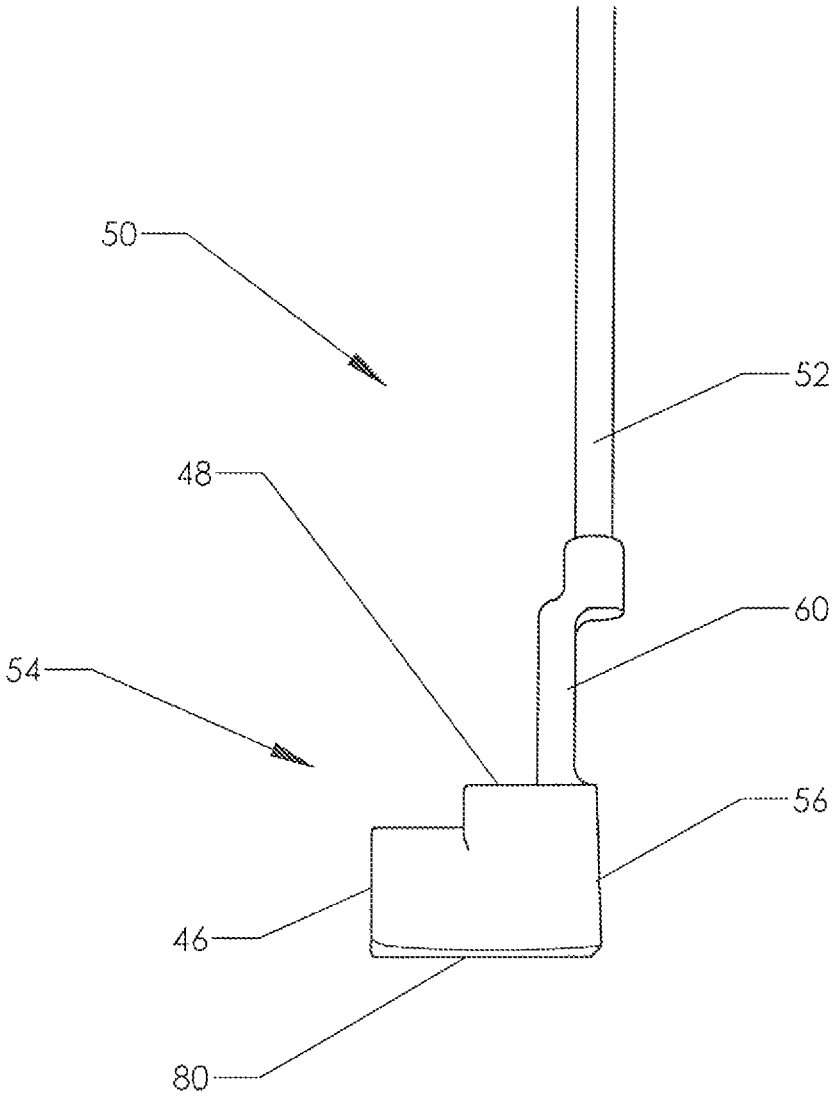
FIG. 6 is a profile view, showing the present invention.

A profile view of putter 50 is shown in FIG. 6, specifically for purposes of illustrating club face 56. Club head 54 includes top 48, back 46, sole 80 and face 56. As the golfer swings the present putter 50, sole 80 travels along the ground or putting green on the golf course. In the preferred embodiment of the present invention, face 56 contains variable loft at multiple facets. FIG. 2 shows an example of a static loft angle 22 on a prior art putter 10. Static loft angle 22 is defined herein as the angle between the axis of shaft and the club face plane 26. Arm A 24 is parallel to the axis of shaft and is shown to better illustrate static loft angle 22. As static loft angle 22 increases more lift is imparted to the golf ball.

Returning to FIG. 6, putter 50 has face 56 wherein the static loft angles vary slightly on multiple facets from top 48 to sole 80 of face 56. Due to the very slight difference in the facets' static loft angles, the facets are illustrated more clearly in the following figures.

Figure 7:
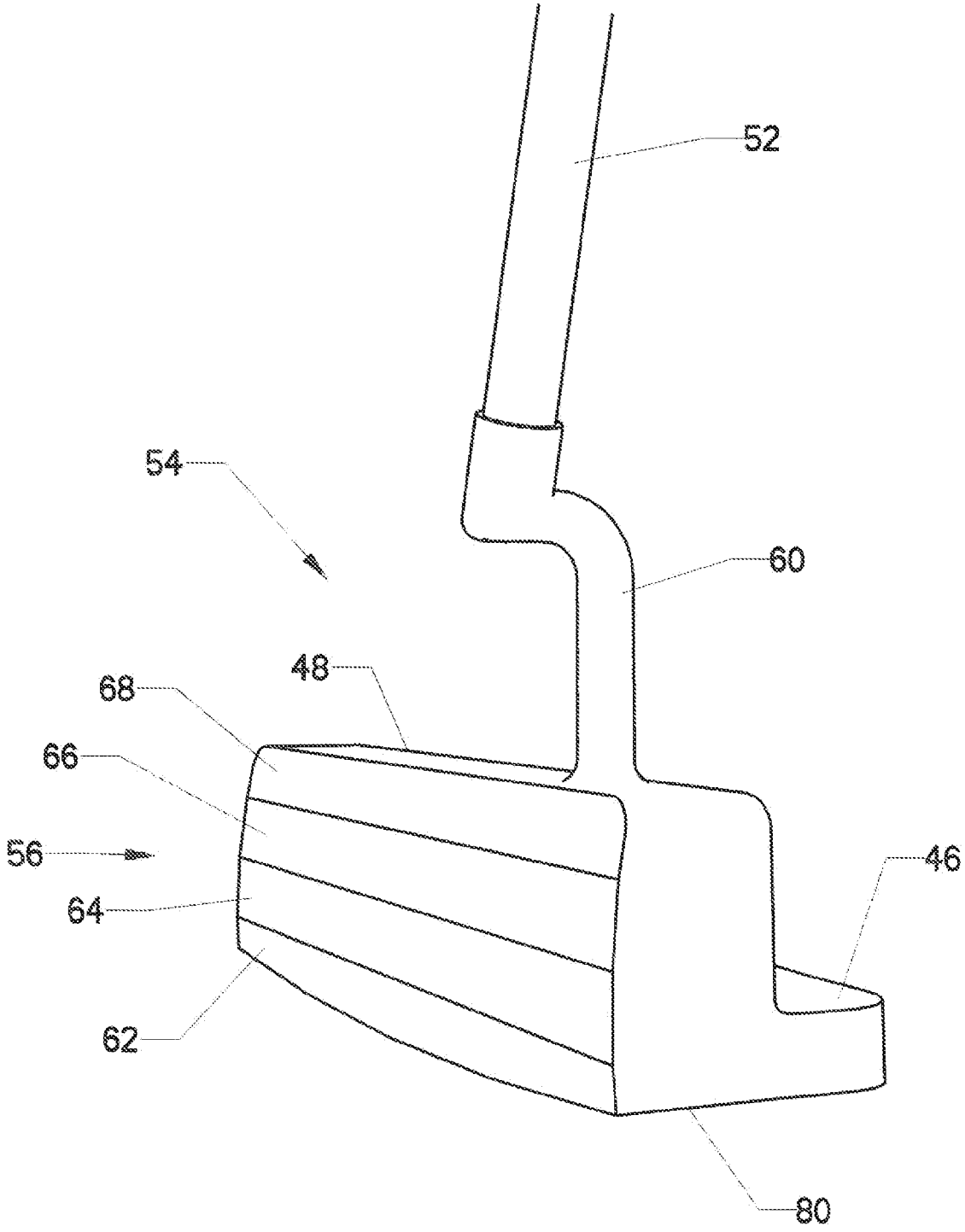
FIG. 7 is a profile view, showing the static loft angles across the face of the present invention.

FIG. 7 shows the variance of static loft angles on multiple facets significantly exaggerated for purposes of illustration. The facets are shown rising up the face 56 of putter as first facet 62, second facet 64, third facet 66 and fourth facet 68. In reality, the slight variance of the facets would be difficult to perceive visually. For clarification purposes, there is shown a 5° difference between facets in the current view. The illustration shows four different planar surfaces or facets 62, 64, 66, 68, along face 56. One skilled in the art will recognize that the same effect can be achieved by two, three or more than four facets along face and the invention is therefore not restricted to four surfaces. To determine the static loft angle, the angular facet is measured from any point on its planar surface and the axis of the shaft. It is desirable that the static loft angles are smaller closer to the sole 80 of the face 56 and greater as they progress upwards towards the top 48 of the face 56, effectively increasing loft ascending upward on club face 56. However, the specific degree of loft angle is not set for purposes of the present invention. For example, facets (62, 64, 66 and 68) could measure +1°, +2°, +3° or +4° rising up the face. Hosel 60 could then be modified to provide a slightly different series of angular facets (such as −1°, 0°, +1°, +2°). However, the distribution of loft on facets of club face would remain the same as the angles are shifted by bending hosel 60.

Figure 3:
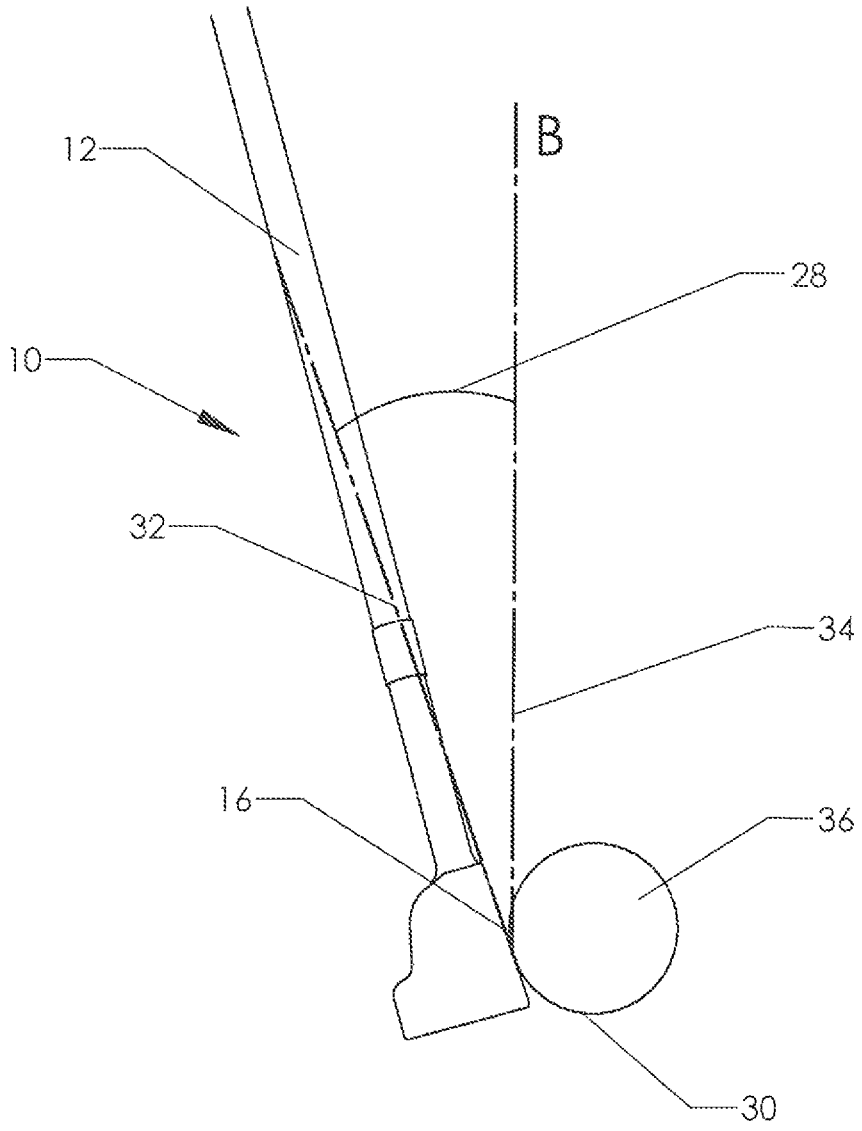
FIG. 3 (PRIOR ART)
FIG. 3 is a profile view, showing the dynamic loft angle for a prior art putter.
Figure 4:
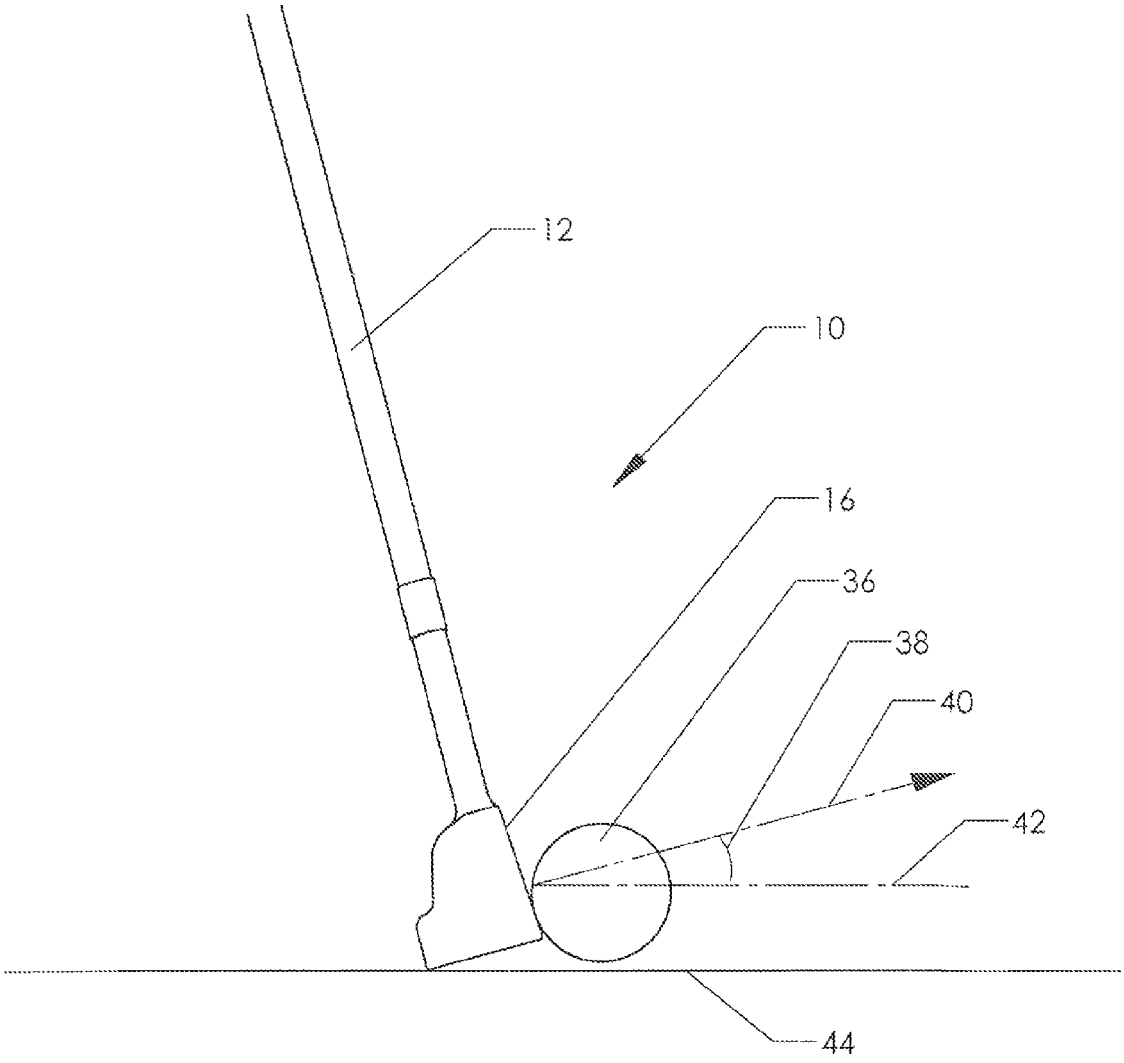
FIG. 4 (PRIOR ART)
FIG. 4 is a profile view, showing the launch angle for a prior art putter.
Figure 8:
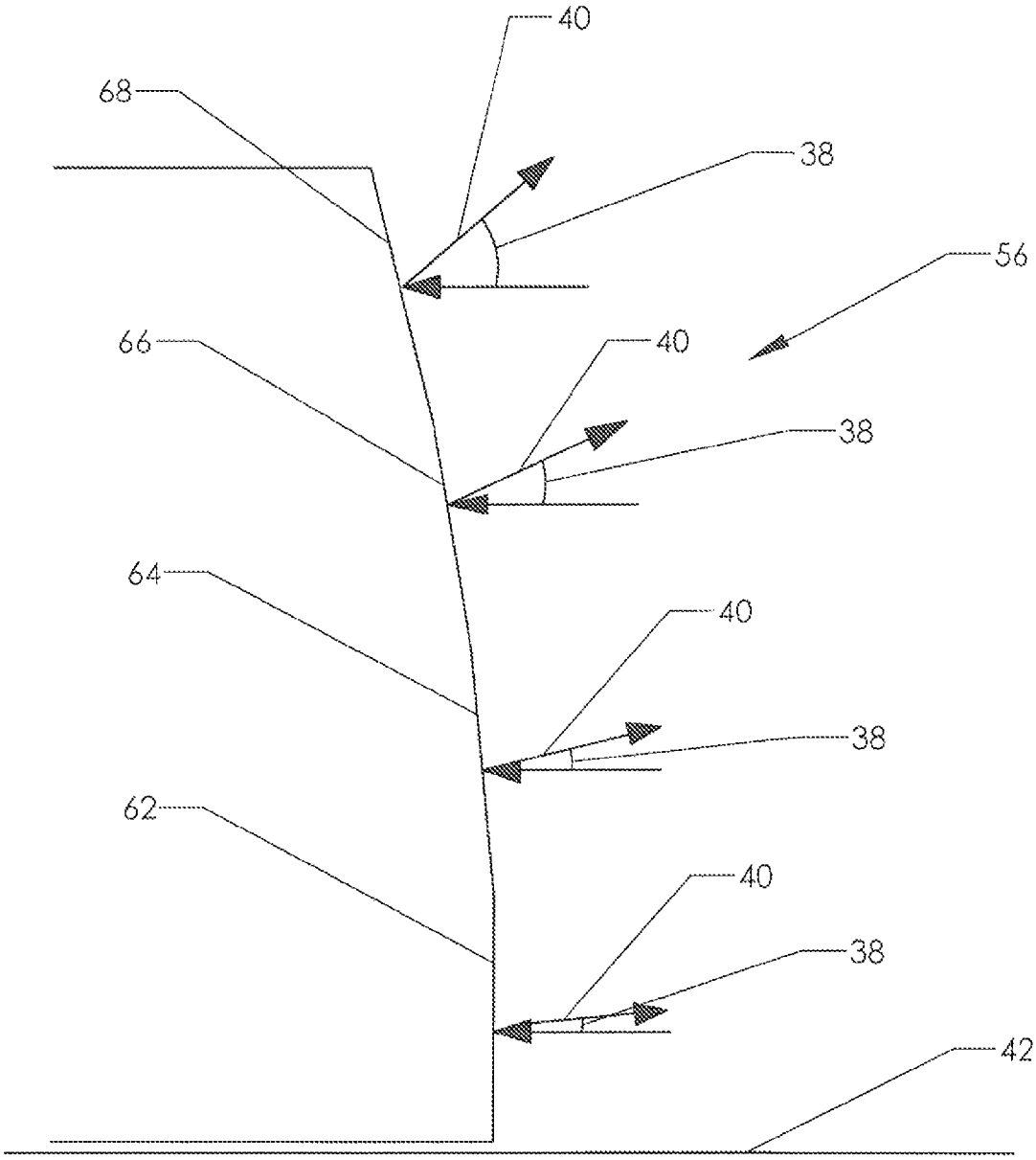
FIG. 8 is a profile view, showing the face of the putter with deflection arrows.

Face 56 of present putter 50 is illustrated in FIG. 8, with the relative angle of deflection (or launch angle) at each facet (62, 64, 66 and 68). Each facet is at a separate angle, thus, there is an identifiable edge where facets meet, although it is difficult to see the edge due to the minor angular change between facets. The angles have been exaggerated to show a 5° shift between angles. These facets have an important function in the present invention as further examined in FIGS. 13-15. FIG. 8 is intended to show the fact that at a greater static loft angle the golf ball is deflected at a greater launch angle. The launch angle 38 is the angle between the horizontal plane 42 and the launch vector 40. Launch vector 40 shows the projected path of the golf ball 36 at its initial launch. Therefore, as the static loft angle decreases down the face of the putter, the launch angle will also decrease where the lean of the shaft and approach to the golf ball remain constant. However, typically when a golfer swings and contacts the golf ball lower than its center of mass, the dynamic loft angle (angle at which the golfer meets the golf ball—where the plane of the club face 32 lies relative to a vertical plane 34—shown in FIG. 3) is greater and less static loft is necessary to achieve optimal launch. It follows that when a golfer contacts the golf ball higher than its center of mass, the dynamic loft angle is lower and more static loft is necessary to achieve optimal launch. It is in this manner and as will be further shown and illustrated the present putter 50 acts to correct imperfections in the golfers swing based on static loft angle on the club face 56. It was previously thought that a launch angle of 3-4° was desirable to achieve the most control over the golf ball. However, the present putter achieves the most effective control over both the distance and direction of the golf ball 36 by imparting a 2-2.5° launch angle.

Figure 9:
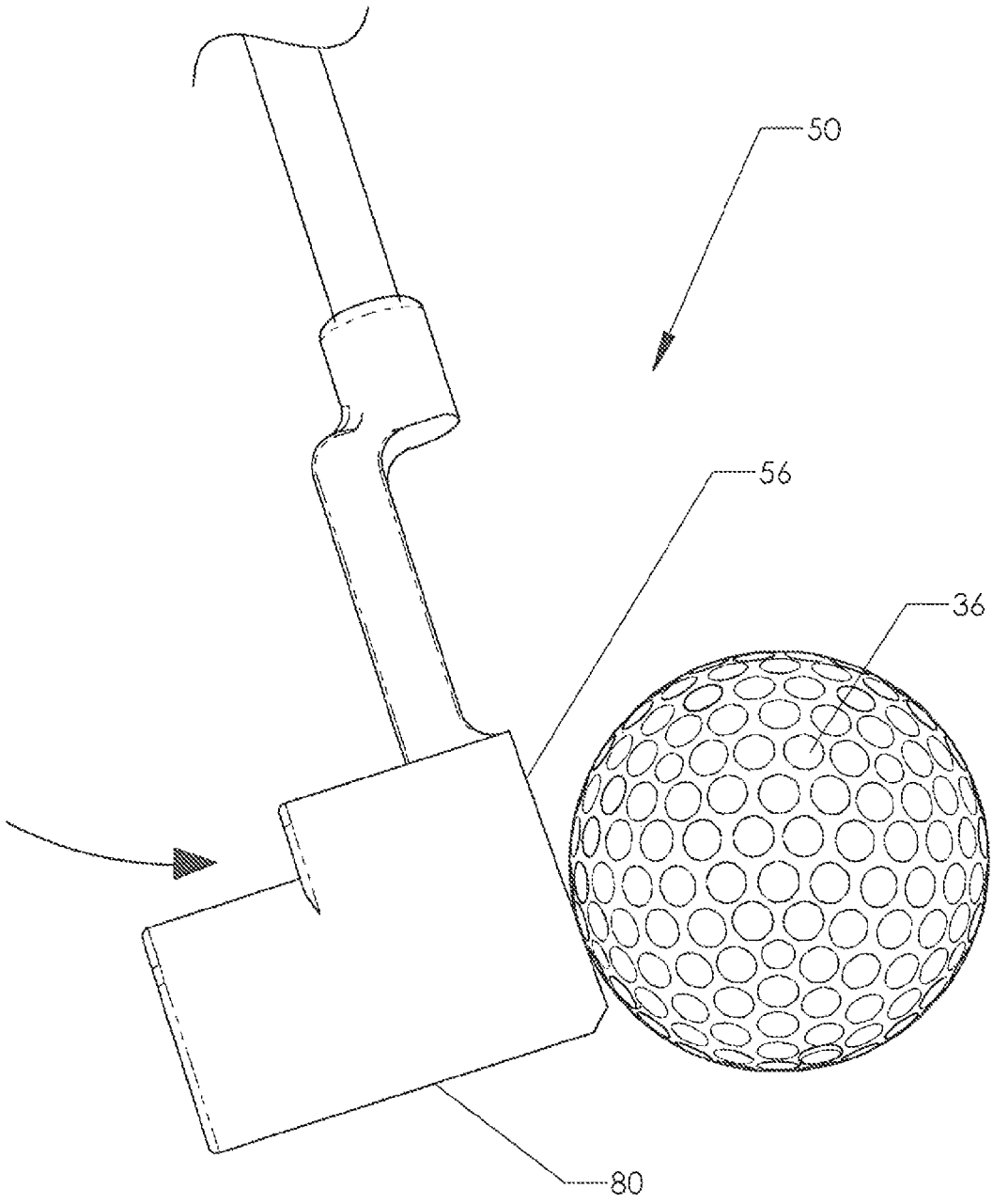
FIG. 9 is a profile view, showing the present invention hitting a golf ball.

For example, in FIG. 9, the present putter 50 is shown, swinging upward at the golf ball. When a golfer swings in this manner, leaning and approaching the golf ball 36 lower than the center of mass of the golf ball, the dynamic loft angle is high. A prior art putter would typically cause the golfer to achieve a launch angle over the optimum range. With the present putter 50, the upward swing naturally causes the golfer to hit low on the face 56 of the putter 50. Due to the fact that the present putter 50 has a smaller static loft angle at the lower end of the face (closest to the sole 80), the dynamic loft angle will not be as great; thus, the launch angle will naturally decrease and tend to achieve an optimal launch angle of 2-2.5°.

Figure 10:
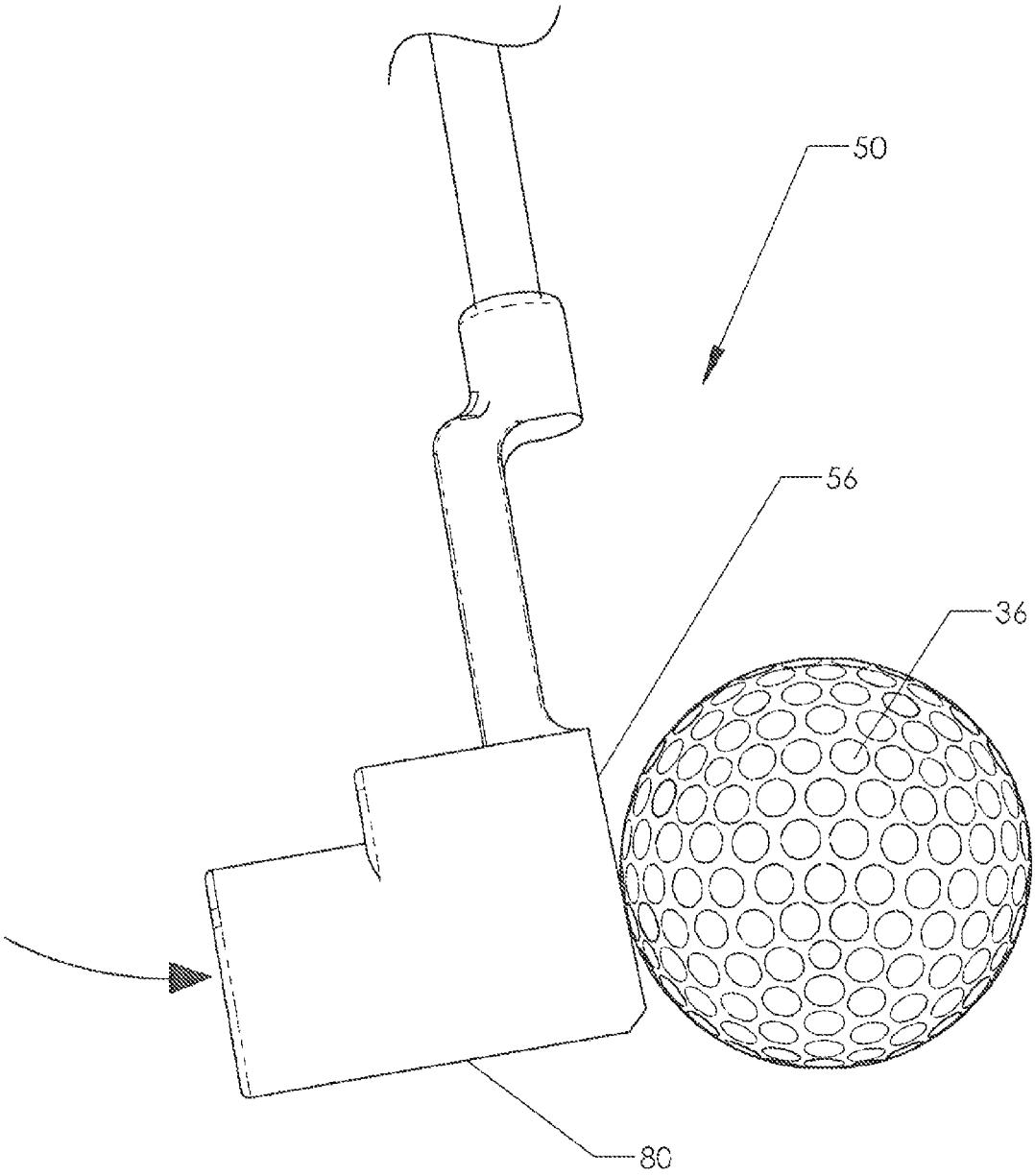
FIG. 10 is a profile view, showing the present invention hitting a golf ball.

FIG. 10 shows an average swing of the present putter 50, with minimal lean of the shaft 12 while approaching and contacting the golf ball 36 near its mid-section. Generally, if the golfer swings the putter 50 in the manner, the desired static loft angle of a putter is greater than that on the lower facet but less than that on the highest facet. The present putter 50 maintains the proper planar surface on the correct portion of the putter face 56 to affect a launch angle of approximately 2-2.5°.

Figure 11:
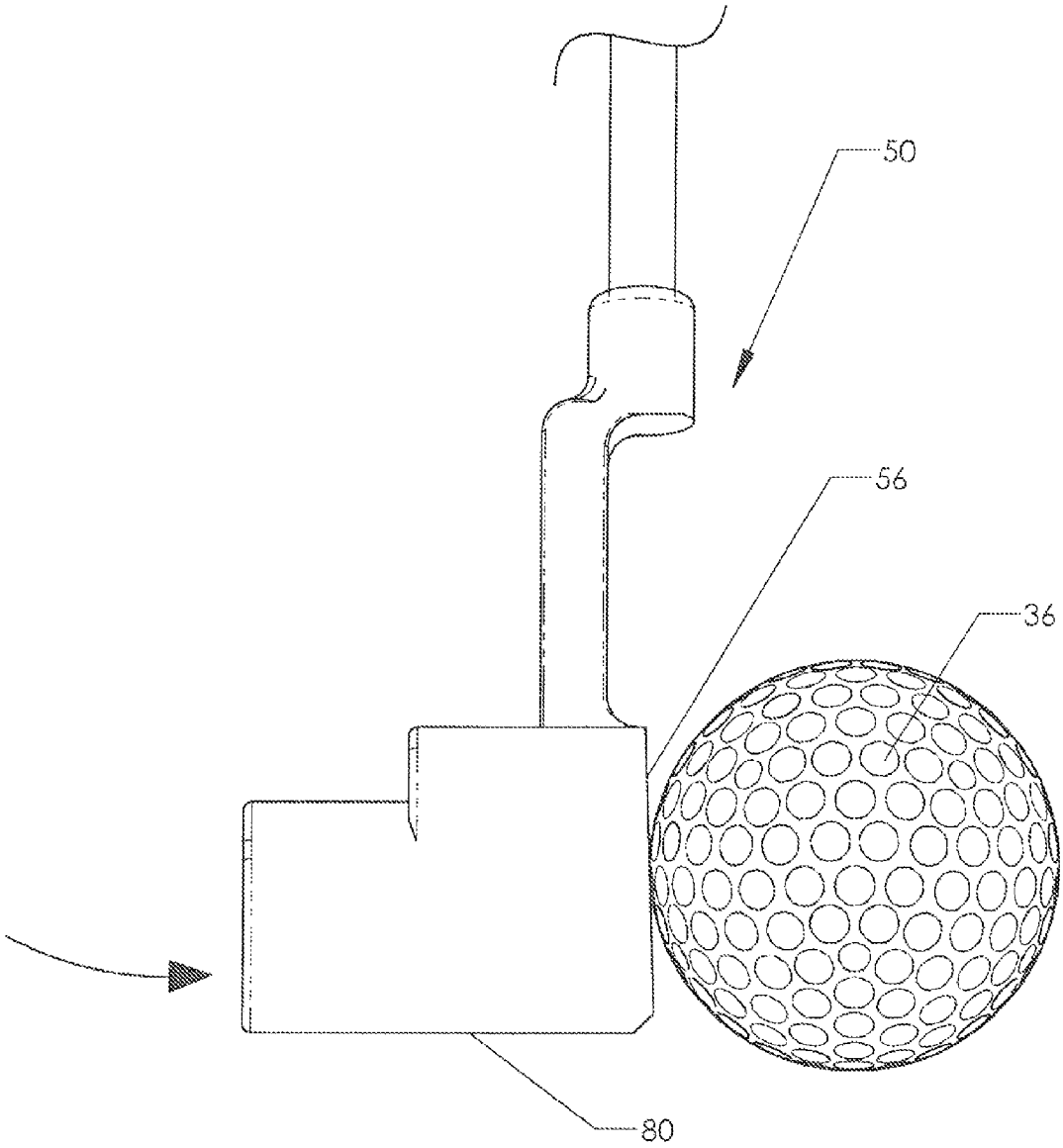
FIG. 11 is a profile view, showing the present invention hitting a golf ball.

Again, in FIG. 11, the present putter face 56 automatically corrects for a specific type of swing by the golfer. FIG. 11 illustrates a "downward" swing on the golf ball 36, wherein the golf ball 36 would, with a prior art putter, not achieve the proper launch angle. However, the present putter 50 has a greater static loft angle on the uppermost facet 68 (FIG. 8) of club face 56. Thus the deflection is greater and the golf ball 36 will achieve the optimal launch angle.

Figure 12:
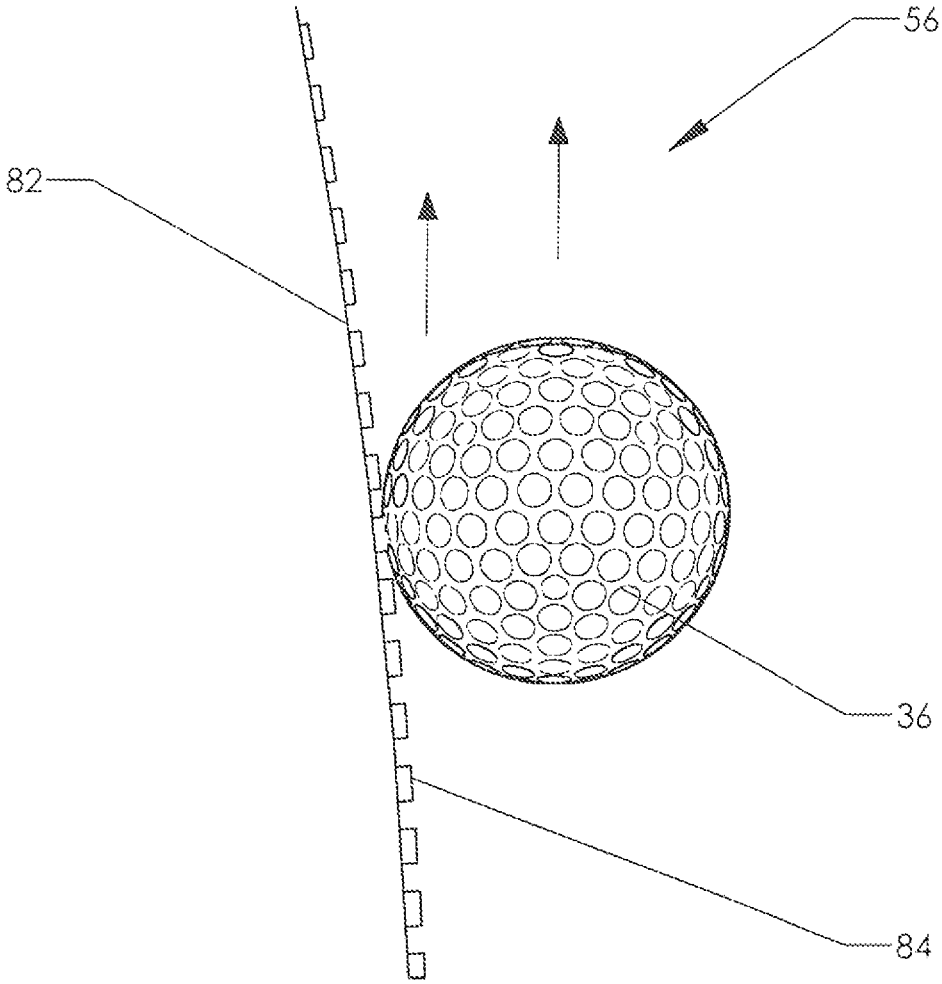
FIG. 12 is a profile view, showing the face of the putter hitting a golf ball.
Figure 13:
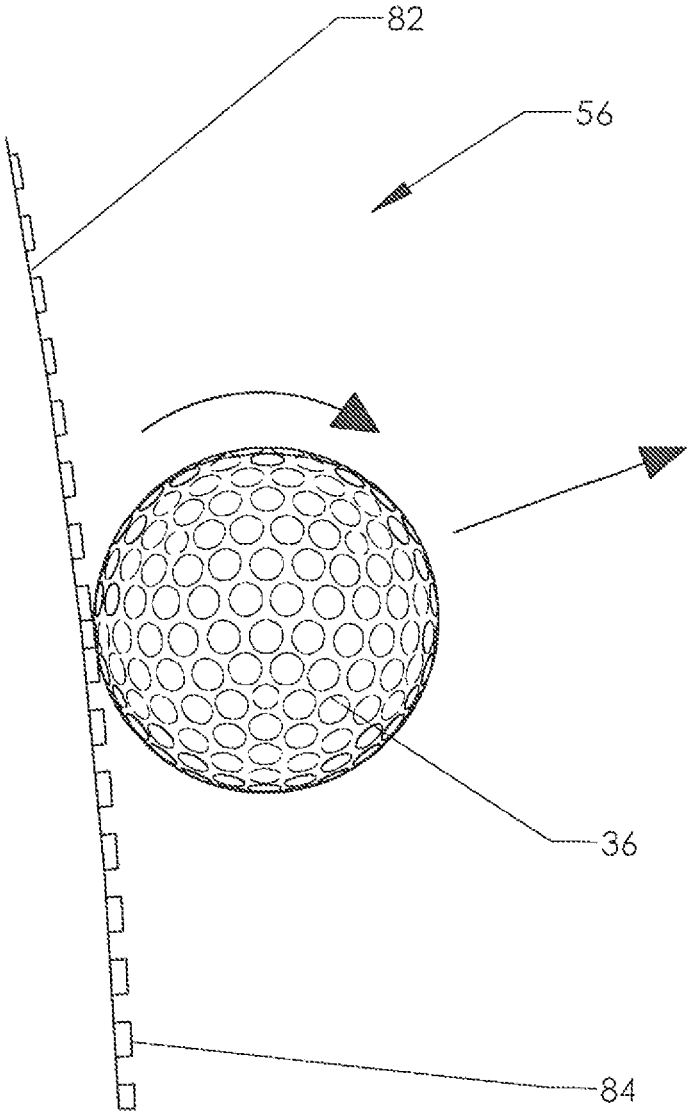
FIG. 13 is a profile view, showing the face of the putter hitting a golf ball.
Figure 14:
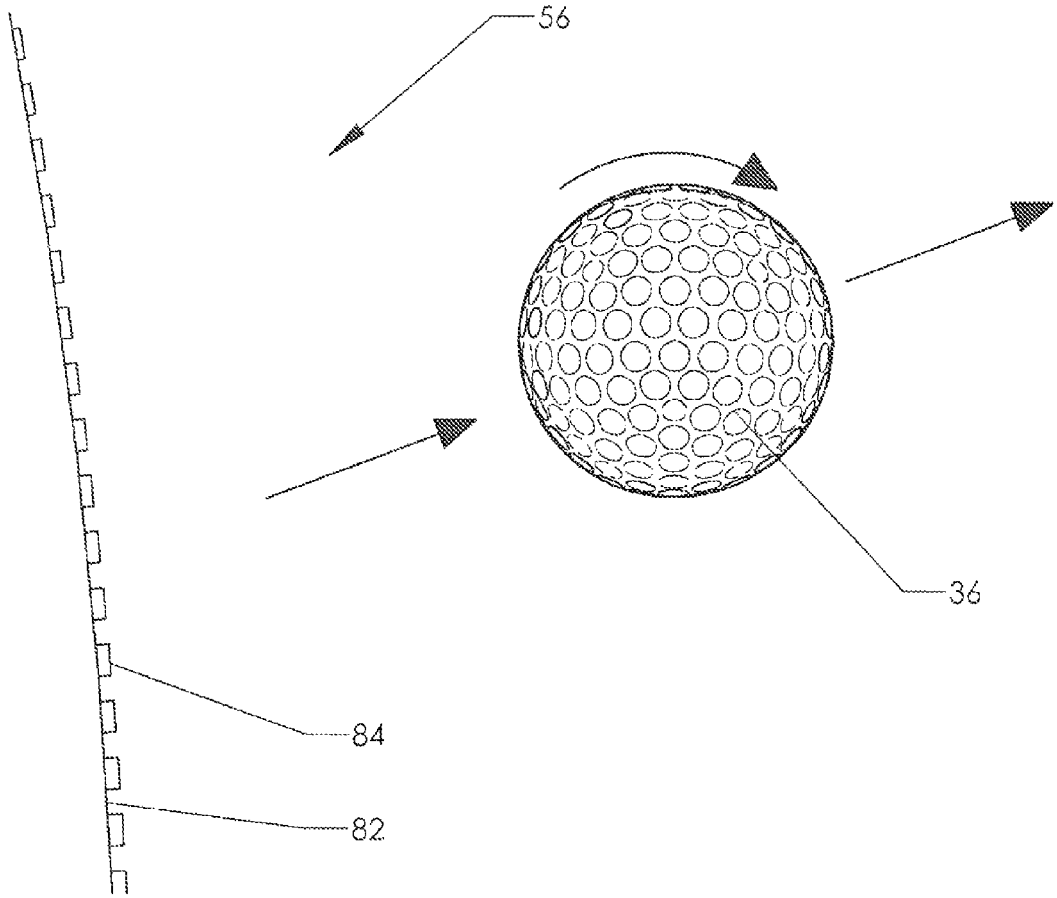
FIG. 14 is a profile view, showing the face of the putter after the golf ball has been struck.

Face 56 of the present putter preferably has a series of grooves and landings in combination with the multiple facets that have an influence on the flight of the golf ball. FIGS. 13-15 show the general path of the golf ball 36 at impact with face 56. The golf ball is not shown to scale with club face 56 for purposes of illustrating the rotation and movement of the golf ball 36 on the club face 56. In reality, golf ball 36 would be much larger, but the same rotational effect would occur. Beginning with FIG. 12, upon contact with club face 56 the golf ball 36 shifts slightly upward along the club face 56 due to the tilted planar surface (static loft angle) of the particular facet (62, 64, 66 and 68) on face 56. The arrows show the projected movement of golf ball 36 upward on club face 56. The grooves 82 and landings 84, along with the points at which the planar surface on the face 56 change in slope, act to grip the golf ball 36 and allow the club to propel the golf ball 36 forward away from face 56, as illustrated in FIG. 13. The golf ball 36 initially began by shifting slightly upward. Club face 56 then shifts upward relative to the golf ball 36 as club face 56 rises in the arc of the swing. Grooves and points at which facets change in slop, act to grip golf ball 36 surface and propel golf ball 36 away from the club face 56 imparting top spin to the golf ball 36. A golf ball launched away from the club face 56 with top spin (as shown in FIG. 14) will achieve true roll quicker upon landing on the green of the course. True roll is when the golf ball rolls end over end with forward motion (over-spin). As previously discussed, the quicker true roll is achieved the more control the golfer will have over the path and distance of the golf ball.

As an additional advantage, the multi-faceted face feature allows each facet to act like an independent club face having only one loft angle. In the alternative, a variable lofted smooth surface allows the golf ball to easily transition up the putter face. This smooth curved surface does not provide for a predictable and controlled release of the golf ball from the club face.

Therefore, the present putter not only provides an optimum launch angle of the golf ball correcting for golfer approach, but also achieves true roll quickly, thereby increasing control over the golf ball.

The preceding description contains significant detail regarding the novel aspects of the present invention. It should not be construed, however, as limiting the scope of the invention but rather as providing illustrations of the preferred embodiments of the invention. As an example, the club face 56 could contain more than four or less than four planar surfaces. Thus, the scope of the invention should be fixed by the following claims, rather than by the examples given.

Having described my invention, I claim:

1. A golf putter for imparting launch to a golf ball at a particular launch angle, said putter comprising:

a. a shaft having an axis;

b. a hosel attached to said shaft;

c. a head attached to said hosel;

d. wherein said head has a face, a top and a sole;

e. wherein said face of said head has multiple facets;

f. wherein said multiple facets are vertically displaced along said face of said putter;

g. wherein each of said multiple facets of said face have a static loft angle defined by the plane of said facet and said axis of said shaft;

h. wherein said static loft angles of said multiple facets is less at said sole of said face and greater at said top of said face;

i. wherein said face has at least four facets; and j. wherein said at least four facets each have a static loft angle, wherein said static loft angles of said at least four facets differ by only 1 degree between abutting facets.

2. A golf putter for imparting launch to a golf ball at a particular launch angle, said putter comprising:

a. a shaft having an axis;
b. a hosel attached to said shaft;
c. a head attached to said hosel;
d. wherein said head has a face, a top and a sole;
e. wherein said face of said head has multiple facets;
f. wherein said multiple facets are vertically displaced along said face of said putter;
g. wherein each of said multiple facets of said face have a static loft angle defined by the plane of said facet and said axis of said shaft;
h. wherein said static loft angles of said multiple facets is less at said sole of said face and greater at said top of said face;
i. wherein said face has at least four facets;
j. wherein said at least four facets have static loft angles such that;
   i. a first facet is closest to the sole of said head and has a first static loft angle;
   ii. a second facet meets and extends above said first facet and has a second static loft angle that is 1 degree less than said first static loft angle;
   iii. a third facet meets and extends above said second facet and has a third static loft angle that is 1 degree less than said second static loft angle; and
   iv. a fourth facet meets and extends above said third face and has a fourth static loft angle that is 1 degree less than said third static loft angle.

3. The golf putter of claim 2, wherein said hosel can be adjusted to modify the orientation of said face in respect to said axis of said shaft.

4. A golf putter for imparting launch to a golf ball, said putter comprising:
a. a shaft having an axis;
b. a hosel attached to said shaft;
c. a head attached to said hosel;
d. wherein said head has a face, a top and a sole;
e. wherein said face of said head has at least four facets, comprising:
   i. a first facet having a first static loft angle;
   ii. a second facet abutting said first facet having a second static loft angle;
   iii. a third facet abutting said second facet having a third static loft angle;
   iv. a fourth facet abutting said third facet having a fourth static loft angle;
f. wherein said static loft angles of said at least four facets is less at said sole of said face and greater at said top of said face; and
g. wherein said static loft angles of said at least four facets differ by only 1 degree between abutting facets.

5. The golf putter of claim 4, wherein said hosel can be adjusted to modify the orientation of said face in respect to said axis of said shaft.

* * * * *